United States Patent [19]

Tischler

[11] 3,993,036

[45] Nov. 23, 1976

[54] INTERNAL COMBUSTION ENGINE

[76] Inventor: Wald E. Tischler, 341 N. Atlantic Blvd., Apt. H, Alhambra, Calif. 91801

[22] Filed: Aug. 27, 1974

[21] Appl. No.: 500,892

[52] U.S. Cl. ..... 123/190 A; 123/80 BA; 123/190 R

[51] Int. Cl.[2] ..... F01L 7/00

[58] Field of Search ..... 123/191 S, 191 SP, 32 C, 123/32 D, 190 R, 190 A, 190 AA, 190 BA, 80 BA, 37, 32 B

[56] References Cited

UNITED STATES PATENTS

| | | | |
|---|---|---|---|
| 1,215,993 | 2/1917 | Rimbach | 123/80 R |
| 1,578,581 | 3/1926 | Casna | 123/190 A |
| 3,060,915 | 10/1962 | Cole | 123/80 BA |
| 3,175,543 | 3/1965 | Drebes | 123/32.4 |

FOREIGN PATENTS OR APPLICATIONS

| | | | |
|---|---|---|---|
| 77,224 | 5/1954 | Denmark | 123/190 A |
| 690,119 | 9/1930 | France | 123/191 SP |
| 669,224 | 5/1935 | Germany | 123/32.4 |

*Primary Examiner*—Wendell E. Burns
*Assistant Examiner*—David D. Reynolds
*Attorney, Agent, or Firm*—Fred N. Schwend

[57] ABSTRACT

An internal combustion engine comprising a cylinder head with a rotary intake and exhaust valves mounted on the head, the head being interchangeable with cylinder blocks intended for conventional poppet type valve engines. According to a basic aspect of the invention, primary and secondary combustion chambers are provided which are isolated from each other by the piston when at the top of its stroke, enabling combustion to initially take place in the primary chamber with a reduced amount of fuel. Optionally, means are further provided to vary the intake valve opening in accordance with changes in speed of the engine.

3 Claims, 10 Drawing Figures

INTERNAL COMBUSTION ENGINE

BACKGROUND OF THE INVENTION

1. Field Of The Invention

This invention relates to internal combustion engines.

2. Description Of The Prior Art

Internal combustion engines of the basic Otto type which are commonly used at present, employing poppet type valves, have certain basic drawbacks which, in spite of many years of research and development, have prevented the efficiency of such engines from being increased beyond the order of 30 percent. For example, poppet valves are generally restricted in size and permissible opening due to camshaft and other limitations and have a constant opening regardless of the engine speed and other variable operating conditions. Therefore, the design of present internal combustion engines represents a compromise of various factors. Also, although such an engine may have a peak efficiency at a certain speed, the efficiency falls off as the speed is increased or decreased beyond such critical point.

Engines incorporating rotary valves have proven superior in certain respects in that they can be made with larger valve openings and with different shaped openings and are not limited by restrictions imposed by camshaft configurations, such as the necessary rise and fall times of the poppet valve operating cams.

Also such rotary valve engines are basically simpler in that they eliminate the need for valve operating trains including valve springs, cam shafts, etc. However, such prior rotary valve engines present other difficulties, such as lack of lubrication and binding tendencies, which have prevented them from being universally accepted even though they represent the possibility of increased efficiency. In addition, such prior rotary valve designs cannot be applied to present engine block assemblies but require a complete redesign of the entire engine.

Furthermore, even such prior rotary valve engines suffer from a relatively low efficiency, even though this may be somewhat higher than poppet type engines.

Accordingly, a principal object of the present invention is to increase the operating efficiency of an internal combustion engine.

Another object is to simplify the construction of an internal combustion engine.

A further object is to provide a rotary valve mechanism which can be applied to the engine block of a conventional poppet valve type internal combustion engine.

A further object is to provide an improved cooling system for a rotary valve type engine.

A further object is to save fuel by using dual combustion chambers where the relationship of fuel density to total cylinder displacement is not the determining factor of engine efficiency.

BRIEF DESCRIPTION OF THE DRAWINGS

The manner in which the above and other objects of the invention are accomplished will be readily understood on reference to the following specification when read in conjunction with the accompanying drawings, wherein.

DESCRIPTION OF THE PREFERRED EMBODIMENTS

Figure 3:
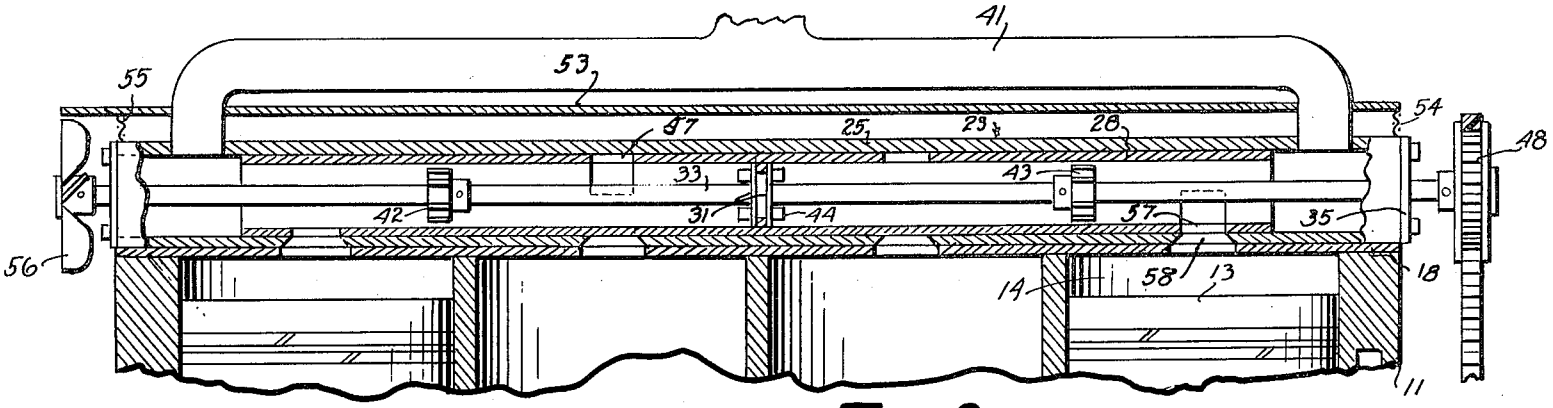
FIG. 3 is a sectional view taken sustantially along the line 3—3 of FIG. 2.
Figure 1:
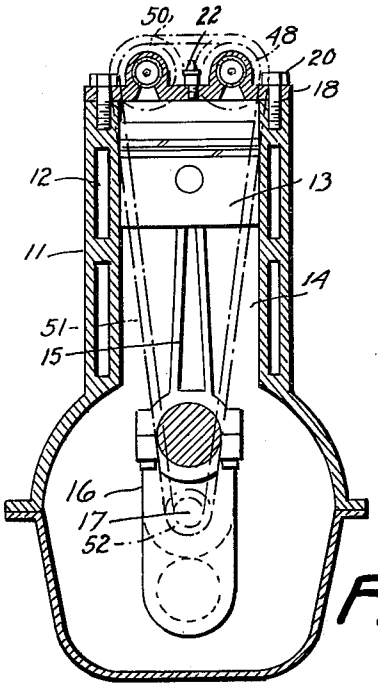
FIG. 1 is a transverse sectional view through an internal combustion engine embodying one form of the present invention.
Figure 2:
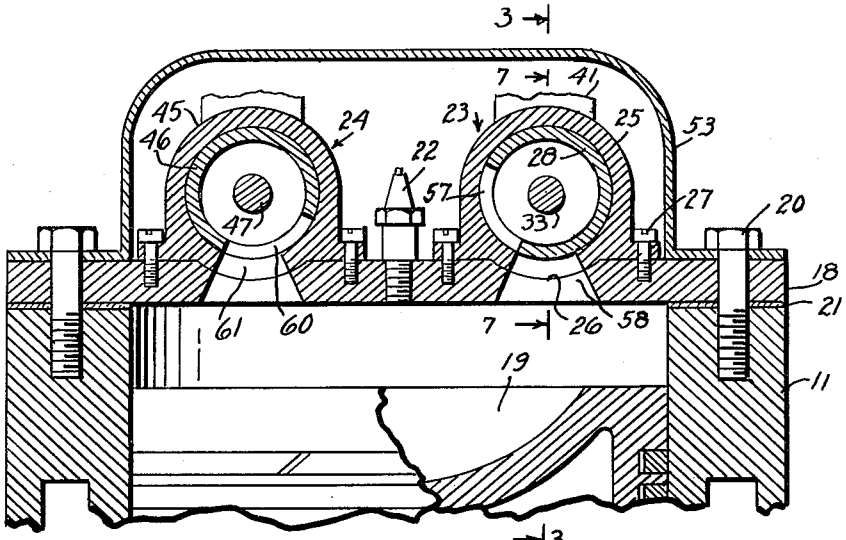
FIG. 2 is an enlarged cross sectional view of the head portion of the engine shown in FIG. 1.

Referring to FIGS. 1 to 3, in particular, a four cylinder internal combustion engine is shown comprising the usual engine block 11 having water cooling passages 12 therethrough, in which water is circulated in a conventional manner (not shown). Pistons 13 are fitted in cylinders 14 and are coupled through connecting rods 15 to the arms of a crank shaft 16 which is rotatably mounted in the engine block 11 for rotation about an axis 17. The block 11 may be that found in a conventional poppet valve type engine in which the cylinder head with poppet valves mounted therein, along with the cam shaft and valve operating train, have been removed.

According to one aspect of the present invention, a cylinder head 18 in the form of a flat plate is secured to the engine block 11 by clamp bolts 20 which also clamp a gasket 21 therebetween. Each piston preferably has a concave cavity 19 in the head thereof to partly form the combustion chamber.

A spark plug 22 is mounted in the head 18 centrally of each cylinder and is fired by a conventional ignition system (not shown).

An intake rotary valve assembly 23 and an exhaust rotary valve assembly 24 are provided, extending the length of the cylinder block.

The intake valve assembly 23 comprises a tubular stator sleeve 25 having a rounded bottom portion fitted in a mating depression 26 formed in the head, the sleeve being clamped in place by screws 27.

Figure 7:
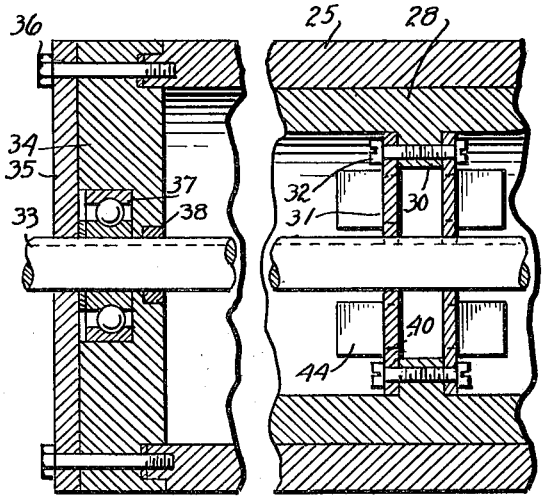
FIG. 7 is an enlarged sectional view, with parts broken away, of one of the rotary valve assemblies and is taken substantially along the line 7—7 of FIG. 2.

A tubular rotor sleeve 28 is rotatably mounted within the stator sleeve 25 and is somewhat shorter. As seen in FIG. 7, an inwardly extending annular flange 30 is formed within the rotor 28 midway between its ends, to which drive discs 31 are secured by screws 32. Such discs are keyed to a drive shaft 33 which extends through bearing housings 34 and end caps 35 secured to the opposite ends of the stator sleeve 25 by bolts 36. Ball bearings 37 are mounted within the bearing housings 34 to rotatably support the opposite ends of the drive shaft 33. The bearing housings 34 and seals 38 mounted therein shield the bearings 37 from heat generated within the engine.

The discs 31 may be solid or may have openings shown by the dotted lines 40 therein to permit flow of gases from one end of the rotor to the other.

An intake manifold 41 connected at its center to a suitable carburetor or other source of explosive gases (not shown) is connected at its ends to the stator sleeve 25 adjacent the ends thereof at locations beyond the ends of the rotor sleeve 28 to convey the gases to both ends of the rotor.

Turbine wheels 42 and 43 are preferably mounted on the drive shaft 33 to cause turbulence of the explosive gases so as to aid in atomizing the same and to prevent coalescence of the liquid fuel particles therein. Also turbine blades 44 are preferally formed on the drive discs 31 to aid in creating turbulence within the rotor sleeve.

The exhaust valve assembly 24 is similar to the intake valve assembly 23 and comprises a stator sleeve 45 and a rotor 46 therein. An exhaust manifold (not shown) similar to the intake manifold 41 but connected to a suitable muffler device, is connected to the stator 45 adjacent its ends.

The rotor sleeve 46 is driven by a drive shaft 47, similar to drive shaft 33, and both shafts have cog belt sprockets shown by the dot-dash lines 48 and 50 in FIG. 1, over which an endless cog belt 51 is wrapped. Belt 51 is also wrapped around a drive sprocket 52 fixed to the crankshaft 16 for rotating the rotor sleeves 28 and 46 at one half the speed of the crank shaft 16.

In order to cool the valve assemblies 23 and 24, an air duct 53 is preferably fitted over both valve assemblies and is secured by the bolts 20 to the upper surface of the cylinder head 18. The duct 53 is open at both ends and is provided with mesh screens 54 and 55 adjacent such ends to exclude foreign matter.

Fans, one of which is shown at 56, are mounted on the ends of the drive shafts 33 and 47 to force cooling air along the duct 53 and over both valve assemblies during operation of the engine.

The materials of the rotor sleeves and stator sleeves are preferably so chosen that they will expand together under the influence of heat developed by the engine. Also, the dimensions of such sleeves are such that a running clearance will be maintained under normal operating temperatures.

Ports or passages 57 are formed in the intake rotor sleeve 28 in alignment with the center of each cylinder 14, such passages passing in coincidence with passages 58 formed in the stator sleeve 25 and head 18 during rotation of the rotor sleeve to control intake of the explosive gases at appropriate times.

Openings 60 likewise formed in the exhaust rotor sleeve 46 to uncover openings 61 in stator sleeve 45 to exhaust gases from the cylinders at proper times.

Figure 4:
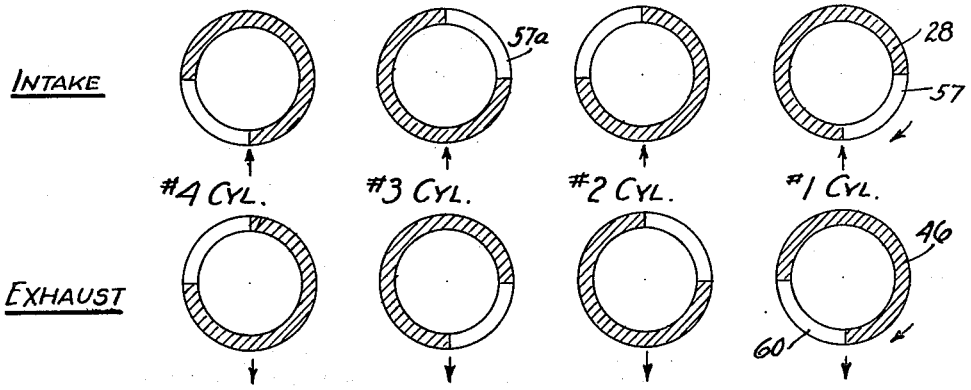
FIG. 4 is a schematic view illustrating the relation of the intake and exhaust valve openings for the different cylinders of a four cylinder engine.

FIG. 4 illustrates diagramatically the relative angular locations of the various rotor openings, i.e. 57 and 60, for both the intake and the exhaust assemblies for all four cylinders, it being considered that the sequence or order of firing of the engine is as follows: Cylinders No. 1, No. 3, No. 2, and No. 4.

Figure 5:
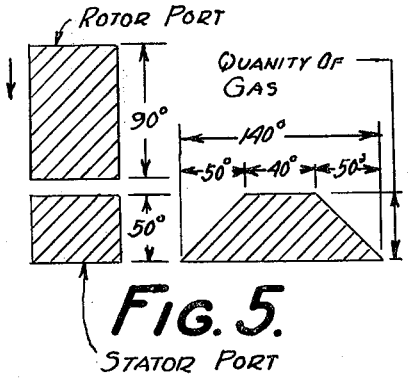
FIG. 5 is a schematic view illustrating the combined openings in the rotor and stator of a rotary valve assembly, showing the net total flow of gas during rotation of the rotor.

FIG. 4 shows the intake passage 57 of the valve assembly for cylinder No. 1 as having just opened. As the piston in No. 1 cylinder moves downward during an intake stroke it will draw the gas mixture through the rotor sleeve 28, passage 57 and into the cylinder. Considering the openings 57 and 60 in the intake rotor sleeve 28 and exhaust rotor sleeve 46 as extending through 90°, and the openings 58 and 61 in the valve stator sleeves as extending through 50°, the overall opening, as depicted in FIG. 5, will extend over 140° of movement of such rotor sleeves.

As soon as the rotor sleeve 28 has passed through 90 degrees, i.e. when the piston has reached the bottom of its stroke, the passage 57*a* in No. 3 cylinder will commence opening and the intake passage 57 of No. 1 cylinder will close. Now, the No. 1 piston will rise, compressing the gas mixture. Near the top of the travel of the latter piston, the spark plug 22 in the No. 1 cylinder will fire, creating a power stroke. At the bottom of such stroke, the passage 60 in the exhaust rotor 46 will open to permit exhausting of the spent gases.

The sequence just described will be repeated successively in No. 3, 2 and 4 cylinders in that order.

Figure 6:
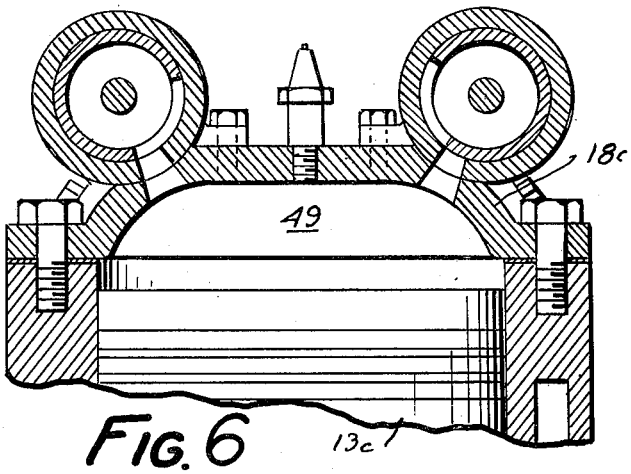
FIG. 6 is a sectional view similar to FIG. 2 but with a domed type cylinder head.

FIG. 6 illustrates an alternate engine construction in which the pistons, i.e., 13*c* are flat topped and the cylinder head 18*c* is formed with a dome 49 over each cylinder to form the combustion chamber.

Figure 8:
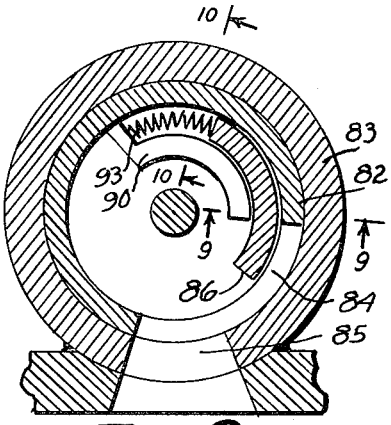
FIG. 8 is a sectional view through the rotary valve of a modified form of the present invention, incorporating a variable valve opening shutter.
Figure 9:
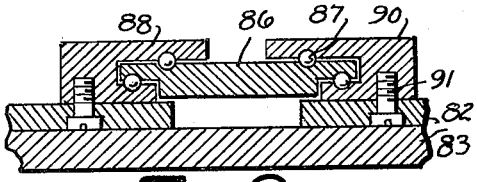
FIG. 9 is a sectional view taken along the line 9—9 of FIG. 8.
Figure 10:
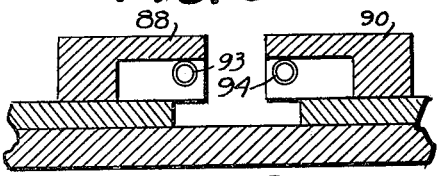
FIG. 10 is a sectional view taken along the line 10—10 of FIG. 8.

FIGS. 8, 9, 10 illustrate a modified form of the invention providing a variable opening for the intake valve assembly, the opening depending on the speed of the engine. For this purpose, the rotor sleeve 82 is, as described heretofore, rotatably mounted in a stator sleeve 83 and has an opening 84 which moves across an opening 85 in the stator sleeve and cylinder 85 to admit the explosive gas from the interior of the rotor to the cylinder. An arcuate shutter 86 extending concentric with the rotor sleeve 82 is mounted by means of ball bearings 87 on arcuate rail members 88 and 90 secured to the interior of the rotor 82 by screws 91. Compression springs 93 and 94 normally locate the shutter 86 in its position shown in FIG. 8, partly covering the rotor opening 84 to reduce the effective valve opening at low engine speeds. However, as the speed of the engine is increased, the inertia of this shutter 86 reacts against the springs 93 and 94 to uncover more of the opening 84. Thus, the effective valve opening will continually vary with changes in engine speed.

In the drawings, the intake and exhaust valves have been shown to be of equal size. However, this need not be the case. For example, the intake valve may be of a greater diameter than the exhaust valve and likewise the openings communicating the intake valves with the cylinders may be larger or smaller than the corresponding openings communicating the exhaust valves with the cylinders.

I claim:

1. An internal combustion engine comprising
a cylinder block having a cylinder,
a piston movable through a stroke in said cylinder,
a cylinder head on said block,
a rotary valve comprising
a stator sleeve on said cylinder head and
a rotor sleeve rotatable in said stator sleeve;
said stator sleeve having a port communicating with said cylinder,
said rotor sleeve having a port for uncovering said stator port,
a shutter rotatably supported by said rotor and
means tending to move said shutter to at least partially cover said rotor port,
said shutter being effective upon increase in engine speed to react against said last mentioned means whereby to uncover a greater amount of said rotor port.

2. An internal combustion engine as defined in claim 1 wherein said last mentioned means comprises spring means normally holding said shutter over at least a portion of said rotor port.

3. An internal combustion engine comprising a cylinder block having a cylinder, a piston movable through a stroke in said cylinder, a rotary intake valve comprising a stator sleeve and a rotor sleeve rotatable in said stator sleeve;

said stator sleeve having a port communicating with said cylinder, said rotor having a port for uncovering said stator port during rotation of said rotor, means for rotating said rotor, means for supplying an explosive gas to said rotor, and means operable by said rotating means for causing turbulence of said gas in said rotor.

* * * * *